United States Patent [19]

Fletcher et al.

[11] 3,978,287

[45] Aug. 31, 1976

[54] REAL TIME ANALYSIS OF VOICED SOUNDS

[76] Inventors: James C. Fletcher, Administrator of the National Aeronautics and Space Administration, with respect to an invention of; Jung P. Hong, Cupertino, Calif.

[22] Filed: Dec. 11, 1974

[21] Appl. No.: 531,575

[52] U.S. Cl. ..... 179/1 SA

[51] Int. Cl.[2] ..... G10L 1/00

[58] Field of Search ..... 179/1 SA, 1 SC, 84 VF; 307/231, 233; 324/77

[56] References Cited

UNITED STATES PATENTS

| | | | |
|---|---|---|---|
| 2,627,541 | 2/1953 | Miller | 179/1 |
| 3,360,610 | 12/1967 | Flanagan | 179/1 SA |
| 3,395,249 | 7/1968 | Clapper | 179/1 SD |
| 3,398,364 | 8/1968 | Rittenbach | 179/1 SA |
| 3,535,454 | 9/1970 | Miller | 179/1 |
| 3,560,852 | 2/1971 | Haskin et al. | 179/1 SA |
| 3,755,627 | 8/1973 | Berkowitz | 179/1 SD |
| 3,780,230 | 12/1973 | Bowen et al. | 179/84 VF |
| 3,803,498 | 4/1974 | Mauch et al. | 307/231 |
| 3,806,664 | 3/1974 | Bowen et al. | 179/84 VF |

*Primary Examiner*—Kathleen H. Claffy
*Assistant Examiner*—E. Matt Kemeny
*Attorney, Agent, or Firm*—Monte F. Mott; Paul F. McCaul; John R. Manning

[57] ABSTRACT

A power spectrum analysis of the harmonic content of a voiced sound signal is conducted in real time by phase-lock-loop tracking of the fundamental frequency, $f_o$, of the signal and successive harmonics $h_l$ through $h_n$ of the fundamental frequency, measuring the quadrature power and phase of each frequency tracked, differentiating the power measurements of the harmonics in adjacent pairs and analyzing successive differentials to determine peak power points in the power spectrum for display or use in analysis of voiced sound, such as for voice recognition.

27 Claims, 4 Drawing Figures

REAL TIME ANALYSIS OF VOICED SOUNDS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

This invention relates to a method and apparatus for exploring the physical characteristics of voiced sounds, and more particularly to improvements in measuring the power distribution in the harmonics of voiced sound signals for spectrum analysis in real time.

There has been a growing interest in exploring the physical characteristics of voiced sounds for such purposes as machine synthesis of speech, machine recognition of speech for identification of an individual, and machine recognition of speech for operation of a typewriter that would thus take spoken dictation. The latter purpose requires speech analysis in real time, but all purposes would benefit by a method of analysis which permits speech recognition in real time.

Prior art techniques have not utilized the harmonic composition of speech as a recognition parameter. It is known that voiced sound may be described in terms of fundamental frequency, harmonic structure, phase and intensity. The pitch of the sound is due to the fundamental frequency, and the quality (timbre) is due to the harmonic structure.

In producing a voiced sound the vocal cords produce small puffs of air the repetition rate of which establishes the fundamental frequency. That rate depends primarily upon the mass, length and elasticity of folds in the vocal cords of the individual. Consequently, the pitch of a speaker is normally fixed in the range from about 80 Hz for men to about 350 Hz for women, although any increase of pressure in the air, as while speaking under tension, or with emphasis or intonation, will increase the fundamental frequency. The converse will of course, produce the opposite effect, i.e., extreme relaxation while speaking will decrease the pressure of the air to decrease the pitch.

Accompanying the fundamental frequency of voiced sound is a complex of simple harmonics which are modulated in intensity and phase by cavities controlled by the speaker. These cavities function as controlled resonators for the harmonics. Modulating the relative amplitude of the harmonic components will produce the different sounds of vowels and consonants. Significantly more power is contained in the sounds of vowels, so that voice recognition will depend largely on the sounds of vowels, although the sounds of consonants are not to be discounted altogether in the speech analysis.

Recognizing that the characteristics of voiced sounds are contained in the modulations of harmonics, the principal method of exploring the characteristics of voiced sounds is power spectrum analysis to determine the power and phase of the harmonic components. One could use a bank of filters, one filter for each harmonic, to isolate the harmonic components and measure the power of each, but since the fundamental frequency will vary significantly from one speaker to the next, and may vary from one moment to the next for an individual speaker, it is sometimes necessary to record the speech sounds and employ repetitive filtering techniques with different banks of filters to determine the harmonic composition with accuracy. Consequently, speech recognition in real time with a high degree of accuracy is not possible with prior art filtering techniques.

An additional parameter useful in speech recognition, is the phase of harmonic components. Such a parameter has not heretofore been used, particularly in real time analysis. It would be desireable to track the harmonics of a voiced sound signal in order to continually measure not only the power but the phase of the harmonics. Such phase data may aid in making more positive voice identification.

SUMMARY OF THE INVENTION

In accordance with the present invention, the power and phase in every harmonic $h_i$, of a predetermined number, $n$, of harmonics $h_1, h_2 \ldots h_n$ of a voiced sound signal is determined in real time by tracking the harmonics with at least one phase-locked loop to produce a local reference signal for each harmonic, and combining the reference signal with the voiced sound signal to detect and determine the power $P_i$ and phase $\phi_i$ of each harmonic $h_i$. The determined power levels $P_1$ through $P_n$ are differenced in successive pairs to obtain for each pair the differential $d_i = P_i - P_{i-1}$. These differences are then differentiated in successive pairs to obtain second differentials $dd_i = d_{i+1} - d_i$. These first and second differentials are then analyzed to determine the peaks of the spectrum. The power and phase measurement for each harmonic is preferably made using a quadrature power and phase meter, and the first and second differentials are preferably formed by differential amplifiers such that a first differential, $d_i$, and the second differential, $dd_i$, of each harmonic, $h_i$, is continually formed. These data, including phase data, are continually sampled and used for real-time power spectra analysis, display, storage or comparison with other previously stored power spectra, as for voice recognition, or to control an external system.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
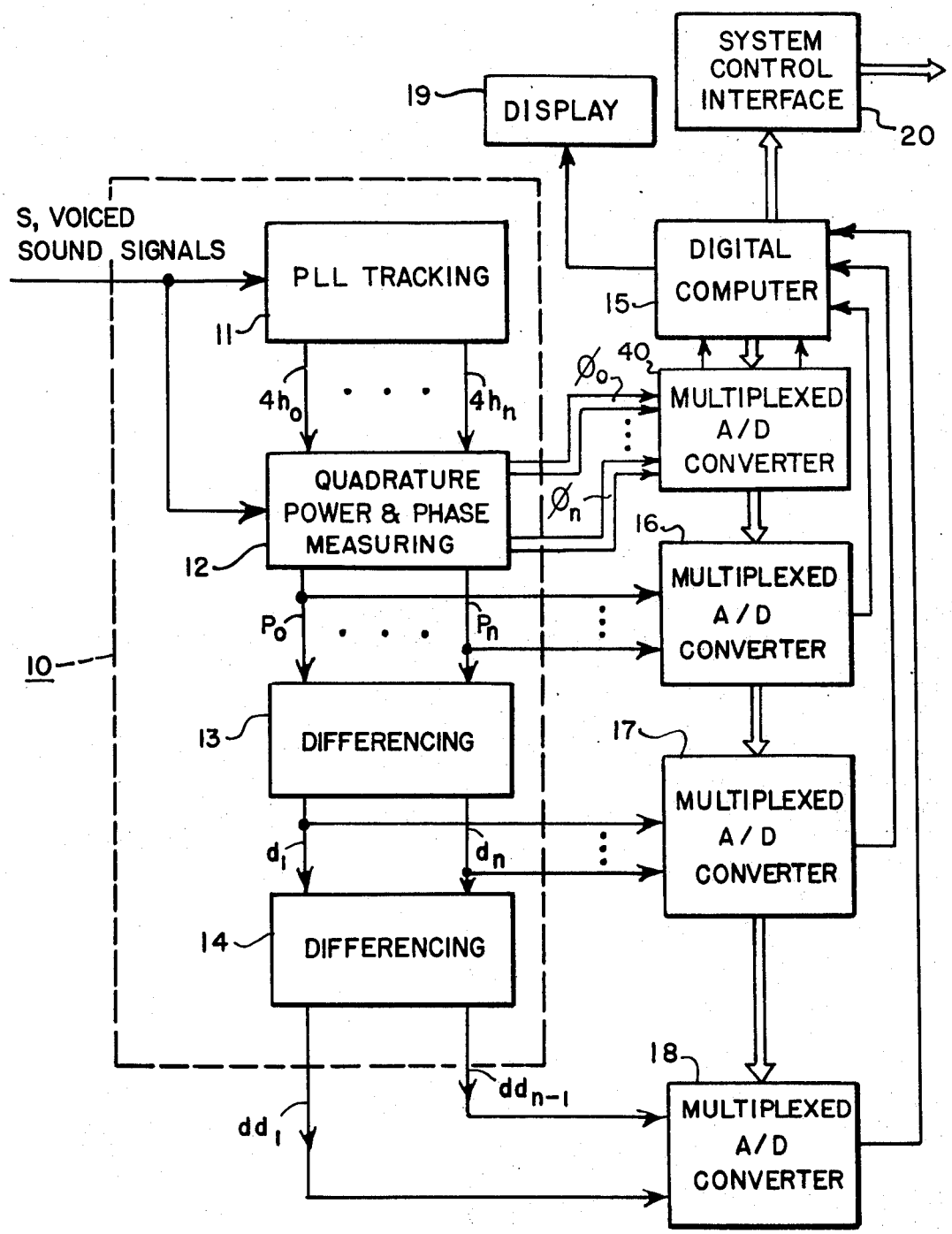
FIG. 1 is a functional block diagram of a power spectrum analysis system in accordance with the present invention.

Referring now to FIG. 1, a voice sound signal, S, is coupled in to a system 10 for tracking the fundamental frequency and harmonics of the sound signal and for deriving power distribution data of the signal in real time. The system employs phase-locked-loop (PLL) tracking means 11 to track the fundamental frequency $f_o = h_o$ and a predetermined number, $n$, of harmonics $h_l$ through $h_n$ of the signal where the harmonics are successive whole multiples of the fundamental frequency. For each harmonic, the tracking means produces a local reference signal at four times the frequency of the harmonic for use in quadrature power and phase measuring means 12 to obtain the power distribution in all of the $n$ harmonics.

The power measurements $P_o$ through $P_n$ of the fundamental $h_o$ and harmonics $h_l$ through $h_n$ are fed to a first differencing means 13 to obtain for each pair of successive harmonics $h_i$ and $h_{i+l}$ their power differential, $d_i = \lambda P_i - P_{i-l}$. These differentials are then applied to a second differencing means 14 for obtaining for each successive pair of first differentials $d_i$ and $d_{i+l}$, a second differential $dd_i = d_{i+l} - d_i$.

The power spectrum data thus derived by the system 10 from the voiced sound signal S are continually sampled by a computer 15 through multiplexed analog-to-digital converters 16, 17 and 18. The computer may be programmed to assume the function of the first and second differencing means, in which case only the multiplexed analog-to-digital converter 16 is required in order for the computer 15 to derive the power spectrum data just referred to for real time analysis, display, storage or comparison with a previously stored power and phase spectrum data, as for voice recognition. Display means 19 is shown for the suggested display function. When speech recognition is carried out by the computer to control an external system, such as an electric typewriter, an interface 20 is provided to convert the real-time voice recognition data developed by the computer to whatever code is necessary for activating some elements of the system, such as the appropriate key of a typewriter.

Although prior art speech recognition techniques have utilized harmonic power spectrums as a recognition parameter, it was not previously known that the harmonics were discrete enough to be individually tracked by phase-locked-loop techniques. It has been discovered by the inventor named in this application through detailed spectrum analysis that the individual harmonics are distinct enough to lock a PLL. By operating the voltage control oscillator (VCO) of the PLL for a given harmonic $h_i$ at some multiple, M, of four times the frequency of the harmonic, a local reference signal at a frequency $4h_i$ can be provided for use in making a quadrature power and phase measurement of the signal at the frequency of the harmonic $h_i$ as shown in FIG. 2.

Figure 2:
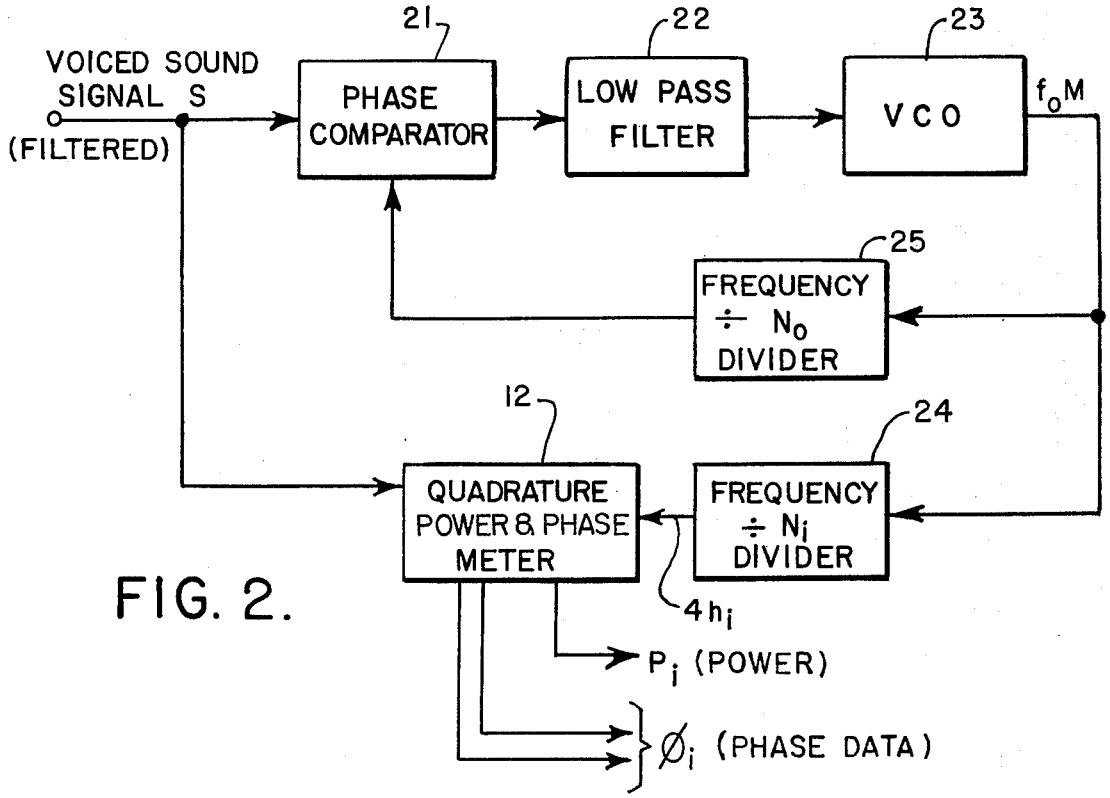
FIG. 2 is a block diagram of a phase-locked loop and quadrature power and phase meter for the $i$th harmonic of the system of FIG. 1.

Referring now FIG. 2, the PLL consists of a phase comparator 21, low pass filter 22 and a voltage control oscillator 23. The latter responds to an error signal from the low pass filter to oscillate at a frequency $Mf_o$, where $f_o$ is the frequency of the fundamental or some selected harmonic $h_i$, and M is an integer selected to be sufficiently large to permit the output frequency $Mf_o$ of the VCO to be divided by an integer $N_i$ in a frequency divider 24 such that the output frequency to the quadrature power measuring means 12 is four times the frequency of a harmonic $h_i$ the power ($P_i$) of which is to be measured. The output of the VCO is divided by $N_o$ in a separate frequency divider 25 to provide a feedback signal to the phase comparator 21 at the frequency of the fundamental or harmonic that is being tracked.

With no audio signal into the phase comparator, the VCO oscillates at a center frequency which is determined by the S curve of the VCO. When an audio signal is received, the VCO output signal is fed back to the phase comparator 21 to control the VCO frequency such that it is M times the frequency being tracked. The multiplying factor M and the integer $N_o$ of the divider 25 selects the harmonic to be tracked.

As the fundamental frequency varies in a spoken expression, all of the harmonics will vary correspondingly. Consequently, it would be theoretically possible to track only the fundamental frequency in the phase-locked loop of FIG. 2, and to employ separate frequency dividers at the output of the VCO to divide down the product $Mf_o$ to the different frequencies $4h_l$, $4h_2 \ldots 4h_n$. However, since the VCO must be able to oscillate at the frequency $Mf_o$, and since the fundamental frequency $f_o$ can be as high as 350 Hz, it is not practical to try to derive a local reference signal for all of the harmonics from a single PLL tracking the fundamental frequency because the integer M must then be so large that the product $Mf_o$ would be a frequency too high for a practical design of the VCO. For instance, if one wanted to be able to measure the power of the fundamental and the first 19 harmonics of the fundamental frequency of 350 Hz, the VCO would have to be operating at a frequency four times $231{,}212{,}520^x f_o$ where the factor 231,212,520 is the least common multiple of the fundamental and 19 harmonics. This frequency is much too high to work with using available VCO circuit techniques.

To avoid having to operate the VCO at such high frequencies, it is preferred that the spectrum of $n$ harmonics $h_l$ through $h_n$ be divided into separate groups such that the frequency $Mf_o$ for each loop can be made much lower. An example of four groups for 19 harmonics of a fundamental at a frequency of 350 follows:

| MULTIPLES (Harmonics) OF $f_o$ | LCM | $4f_o$ LCM |
|---|---|---|
| 2, 4, 5, 8, 15, 16, 20 | 240 | 336,000 |
| 3, 6, 9, 14, 18 | 252 | 152,800 |
| 11, 13 | 143 | 210,200 |
| 17, 19 | 323 | 452,200 |

In that manner four phase-locked loops operating at less than 1 megahertz will yield the 19 multiples of a fundamental frequency $f_o$ required to analyze the power in 19 harmonics. The bank of four phase-locked loops effectively track each of the frequencies of the fundamental and 19 successive harmonics, $h_l$, $h_2$, . . . $h_{19}$. The VCO frequency is then divided down by the appropriate number to obtain the reference frequencies $4h_1$, $4h_2 \ldots 4h_{19}$ for use in separate quadrature power and phase meters to determine the values $P_1$, $P_2 \ldots P_{19}$ of power and $\phi_1$, $\phi_2 \ldots \phi_{19}$ of phase in the harmonics. The power and phase in the fundamental, $f_o = h_o$, can be similarly measured with a reference frequency derived from the PLL of any one of the four groups.

As an alternative to grouping the harmonics into four PLL's, it would be possible to provide 20 separate PLL's for the fundamental and each of 19 harmonics. The VCO for a given harmonic $h_i$ would then need to be operating at a frequency that is only four times the frequency of the harmonic. The frequency divider 25 would divider by 4 and the frequency divider 24 would be omitted. This approach of providing a separate PLL for each harmonic is not as impractical as it might seem since the added cost of providing a phase comparator, low pass filter and VCO for each harmonic is offset by reduced cost in the frequency divider 25, a reduced cost in a design of the VCO, and the elimination of the entire cost for the frequency divider 24. What makes that possible is the discovery by the aforesaid inventor that the individual harmonics are discrete enough to be tracked by a PLL.

Figure 3:
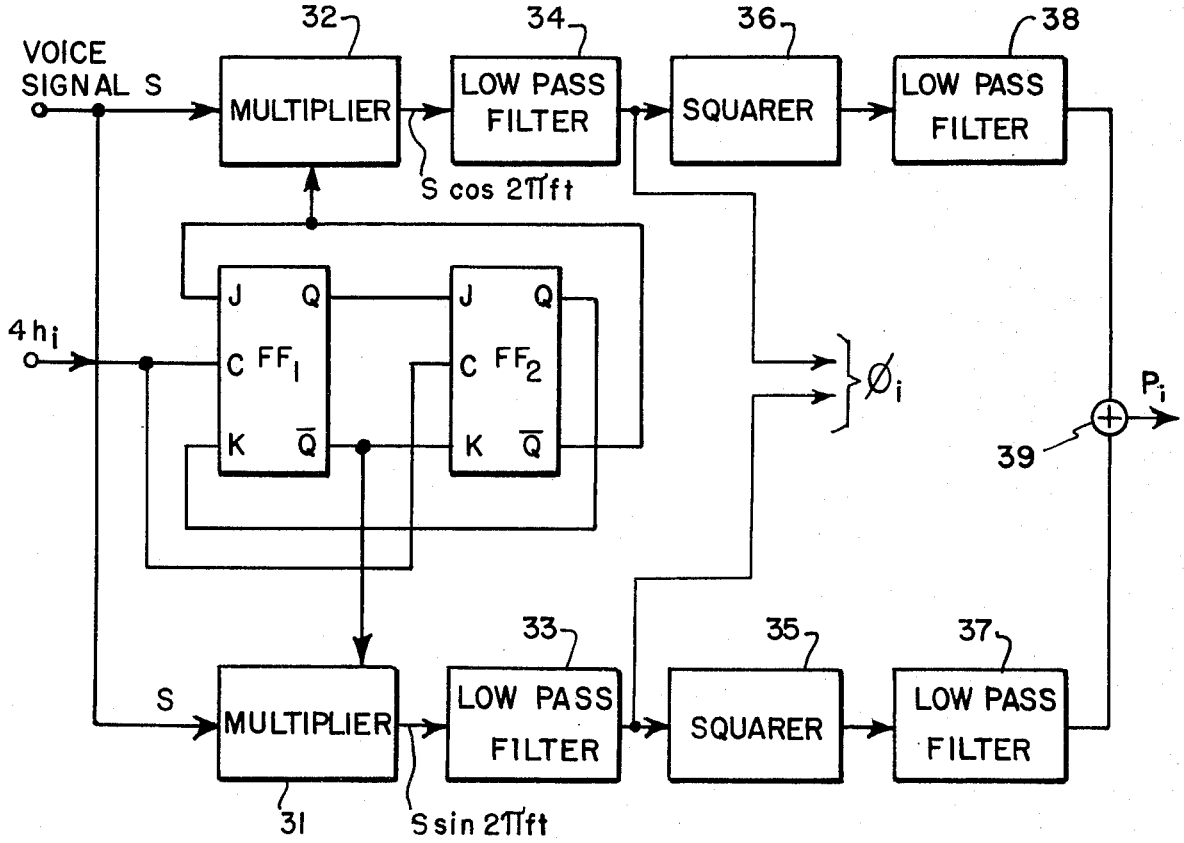
FIG. 3 is a block diagram of the quadrature power and phase meter of FIG. 2.

A block diagram of a quadrature power meter used in the power measuring means 12 for a given harmonic $h_i$ is shown in FIG. 3. Two flip-flops $FF_1$ and $FF_2$ receive the reference signal at the frequency $4h_i$ and produce four signals at the frequency of the harmonic $h_i$ at 90° phase intervals. Only two of them 90° out of phase with each other are used. Those correspond to multiplying the incoming signal, S, by sin $(2\pi ft)$ and cosine $(2\pi ft)$ in respective multipliers 31 and 32 because low pass filters 33 and 34 pass only the low frequency component of the product of the signal and the square wave. The output signals of the low pass filters 33 and 34 therefore correspond respectively to the correlation of the input signal S with sin $(2\pi ft)$ and cos $(2\pi ft)$. These correlation signals can be used to find the phase of the component of the voice signal which is at the frequency of the harmonic $h_i$. That phase information provides an additional parameter useful in voice recognition. The arc tangent of the ratio of the sine to the cosine products yields a phase angle $\phi_i$ between the incoming signal S and the VCO output. Squaring the sine and cosine products from the low pass filters 33 and 34 in four quadrant squaring circuits 35 and 36 yields the power $P_i$ at the near frequency of the harmonic $h_i$ in the voice signal when the output of squaring means 35 and 36 are filtered in low pass filters 37 and 38 and added in a summing circuit 39.

The phase-locked loops operating into 20 quadrature power meters as described with reference to FIGS. 2 and 3 yield 20 power outputs $P_0$ through $P_{19}$ which are differenced by first and second differencing means 13 and 14 as shown in FIG. 1 to obtain the harmonics at which the power peaks occur in the power spectrum by effectively determining where the local maxima occur. The first and second differencing means may be implemented as shown in FIG. 4 using two banks of differential amplifiers.

To understand the operation of these first and second differencing means in determining where the local maxima occur, it should be noted that by definition the local maxima of a curve of plotted power measurements $P_0$ through $P_{19}$ is that point at which a first differential of the curve is zero and a second differential is negative. With the 20 discrete power measurements evenly spaced out, the first and second differentials can be obtained directly from the difference between successive power measurements. All that is needed is a bank of differential amplifiers as shown for the first differencing means 13 to obtain a set of first differentials $d_1$ through $d_{19}$ where $d_1=P_1-P_0$, $d_2=P_2-P_1 \ldots d_i=\lambda P_i-P_{i-1}$. If differences between successive ones of these first differentials are then obtained in the second differencing means 14 comprised of a bank of differentials amplifiers, a set of second derivatives $dd_1$ through $dd_{18}$ are obtained where $dd_1=d_2-d_1$, $dd_2=d_3-d_2 \ldots dd_i=d_{i+1}-d_i$. If a first differential $d_i$ is zero and the second differential $dd_i$ is negative, there is a peak at the harmonic frequency $h_i$. Also if the sign between two successive first differentials $d_i$ and $d_{i+1}$ changes from positive to negative there is a peak at the harmonic $h_{i+1}$. The converse of both tests is true about low points or minima in the power spectrum. The harmonic frequencies at which maxima, or maxima and minima occur are thus continually determined for real time recognition or other analysis of voiced sound.

Figure 4:
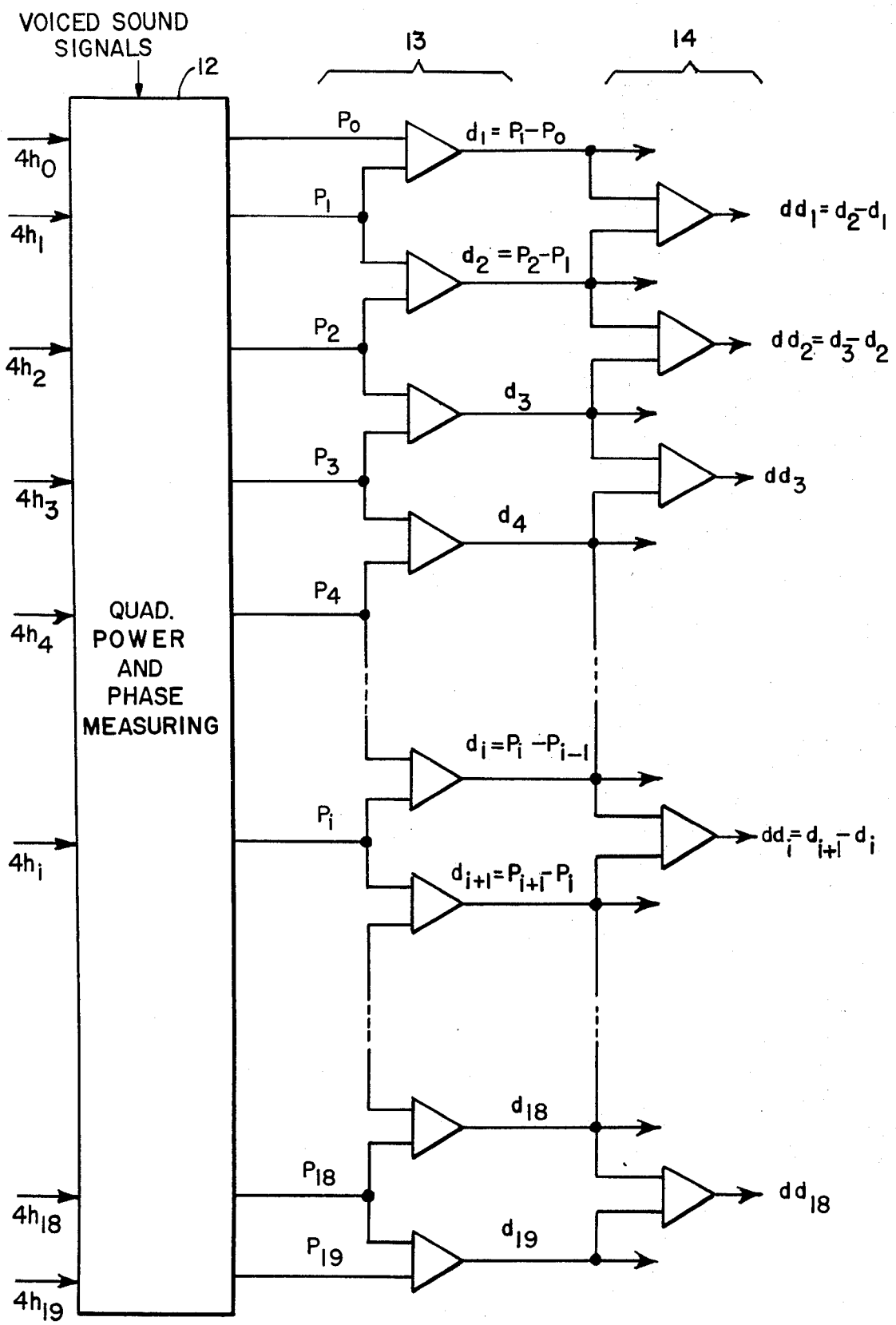
FIG. 4 is a schematic diagram of apparatus for effectively forming first and second differentials of power measurements between successive harmonics $h_i$ and $h_{i+1}$ in the spectrum of harmonics $h_1$ through $h_n$.

As noted hereinbefore, the function of the first and second differencing means may be carried out by the computer, but since real time power spectrum analysis is desired, it would be preferable to relieve the computer of that task by providing first and second differencing means as shown in FIG. 4. The computer then need only sample the outputs of the first and second differencing means to determine whether or not the samples from the first differencing means are zero and whether or not the signs of the samples of the second differencing means are negative.

As noted hereinbefore with reference to FIG. 3, the output signals of the low pass filters 33 and 34 can be used to find the phase of the component of the voice signal which is at the frequency of the harmonic $h_i$. Consequently, the quadrature power meter also provides a phase measuring function in that those signals constitute phase data, i.e., those signals represent the phase angle $\phi_i$ in that they are proportional to the sine and cosine of the harmonic $h_i$ present in the voice signal S. To obtain the actual phase angle measurement, the digital computer can compute the arc tangent of the ratio of the output signal of the filter 33 to the output signal of the filter 34. For that purpose, a multiplexed analog-to-digital converter 40 continually converts the sine and cosine signals, the phase data signals, to digital form. The phase angle, $\phi_i$, may be displayed and processed as a supplemental parameter useful in making more positive voice identification.

Although particular embodiments of the invention have been described and illustrated herein, it is recognized that modifications and variations may readily occur to those skilled in the art. For example, in implementing the first and second differencing means as illustrated in FIG. 4, just three differential amplifiers arranged in a pyramid (two feeding one) could be time shared to form all differentials by use of multiplexing techniques. It is therefore intended that the claims be interpreted to cover such modifications and variations.

What is claimed is:

1. A method for conducting real time power spectrum analysis of the harmonic content of a voiced sound signal comprising the steps of using at least one phase-locked loop having a voltage controlled oscillator for tracking at least one of said harmonics in said signal, said oscillator producing a signal at some multiple of the harmonic being tracked, and developing for each harmonic a local reference signal that is a submultiple of the oscillator frequency by dividing down from the higher oscillator frequency synchronized by said phase-locked loop with the harmonic being tracked, using said voice sound signal and the local reference signal thus produced for each harmonic to continually measure the power of the harmonic in said sound signal, continually differencing power measurements between adjacent harmonics to obtain first differentials, and continually analyzing successive differentials to determine where local maxima of power measurements occur in the harmonic spectrum.

2. A method as defined in claim 1 wherein analysis for determining where local maxima of power measurements occur includes continually differencing between adjacent first differentials to obtain second differentials.

3. A method as defined in claim 1 wherein all of said harmonics are judiciously divided into unique groups to provide for each group a lowest common multiple of all harmonic frequencies in the group substantially lower than for all harmonics of the spectrum of interest, and wherein a separate phase-locked loop is provided for each group to track one harmonic of its group, and said higher frequency synchronized by a phase-locked loop assigned to a group is a product of the lowest common multiple of all harmonics of the group.

4. A method as defined in claim 3 wherein said higher frequency is the product of the lowest common multiple of all harmonics of the group and a factor of four, and wherein said higher frequency is divided down for each harmonic to produce a local reference signal that is four times the harmonic frequency for use in the power measurement step for quadrature phase detection of the component of said signal at the frequency of the harmonic the power of which is to be measured, and for developing sine and cosine correlation signals useful in finding the phase of the component which is at the frequency of the harmonic as an additional parameter to be used in voice recognition.

5. A method as defined in claim 2 wherein said first differentials are continually formed by subtracting an analog power measurement of one harmonic from another.

6. A method as defined in claim 5 wherein said second differentials are continually formed by subtracting one analog first differential signal from another.

7. A method as defined in claim 6 wherein said power measurement, first differential signals and second differential signals are continually converted from analog to digital form for said spectrum analysis in a digital computer.

8. In apparatus for conducting real time power spectrum analysis of the harmonic content of a voiced sound signal, the combination comprising at least one phase-locked loop having a voltage controlled oscillator for tracking at least one of said harmonics in said signal, said oscillator producing a signal at some multiple of the harmonic being tracked, and developing for each harmonic a local reference signal that is a submultiple of the oscillator frequency by dividing down from the higher oscillator frequency synchronized by said phase-locked loop with the harmonic being tracked, separate means responsive to said sound signal and the local reference signal thus produced for each harmonic for continually measuring the power of the harmonic in said sound signal, means for continually differencing power measurements between adjacent harmonics to obtain first differentials, and continually differencing between adjacent first differentials to obtain second differentials.

9. The combination defined in claim 8 wherein all of said harmonics are judiciously divided into unique groups to provide for each group a lowest common multiple of all harmonic frequencies in the group substantially lower than for all harmonics of the spectrum of interest, and wherein a separate phase-locked loop is provided for each group to track one harmonic of its group, and said higher frequency synchronized by a phase-locked loop assigned to a group is a product of the lowest common multiple of all harmonics of the group.

10. The combination defined in claim 9 wherein said higher frequency is the product of the lowest common multiple of all harmonics of the group and a factor of four, and wherein said higher frequency is divided down for each harmonic to produce a local reference signal that is four times the harmonic frequency for use in said means for power measurement, said power measuring means including means for quadrature phase detection of the component of said signal at the frequency of the harmonic the power of which is to be measured.

11. The combination defined in claim 8 wherein said means for obtaining said first differentials is comprised of means for subtracting an analog power measurement of one harmonic from another.

12. The combination defined in claim 11 wherein said means for obtaining said second differentials is comprised of means for subtracting one analog differential signal from another.

13. A method for obtaining power and phase data on the harmonic content of a voiced sound signal comprising the steps of using at least one phase-locked loop having a voltage controlled oscillator for tracking at least one of said harmonics in said signal, said oscillator producing a signal at a frequency that is some multiple of the harmonic being tracked, and developing for each harmonic a local reference signal that is a submultiple of the oscillator frequency by dividing down from the higher oscillator frequency signal that is synchronized by said phase-locked loop with the harmonic being tracked, and using the local reference signal thus produced for each harmonic to continually measure the power of the harmonic in said sound signal, and to continually generate phase data signals of the harmonic in said sound signal relative to said local reference signal.

14. The method of claim 13 including the steps of continually differencing power measurements between adjacent harmonics to obtain first differentials, and continually analyzing successive differentials to determine where local maxima of power measurements occur in the harmonic spectrum for real time power spectrum analysis.

15. A method as defined in claim 14 wherein analysis for determining where local maxima of power measurements occur includes continually differencing between adjacent differentials to obtain second differentials.

16. A method as defined in claim 14 wherein all of said harmonics are judiciously divided into unique groups to provide for each group a lowest common multiple of all harmonic frequencies in the group substantially lower than for all harmonics of the spectrum of interest, and wherein a separate phase-locked loop is provided for each group to track one harmonic of its group, and said higher frequency synchronized by a phase-locked loop assigned to a group is a product of the lowest common multiple of all harmonics of the group.

17. A method as defined in claim 16 wherein said higher frequency is the product of the lowest common multiple of all harmonics of the group and a factor of four, and wherein said higher frequency is divided down for each harmonic to produce a local reference signal that is four times the harmonic frequency for use in the power measurement step for quadrature phase detection of the component of said signal at the frequency of the harmonic the power of which is to be measured, and for developing sine and cosine correlation signals useful in finding the phase of the component which is at the frequency of the harmonic as an additional parameter to be used in voice recognition.

18. A method as defined in claim 15 wherein said first differentials are continually formed by subtracting an analog power measurement of one harmonic from another.

19. A method as defined in claim 18 wherein said second differentials are continually formed by subtracting one analog differential signal from another.

20. A method as defined in claim 19 wherein said phase data, power measurement, first differential signals and second differential signals are continually converted from analog to digital form for said analysis in a digital computer.

21. In apparatus for conducting real time power spectrum analysis of the harmonic content of a voiced sound signal, the combination comprising at least one phase-locked loop having a voltage controlled oscillator for tracking at least one of said harmonics in said sound signal, said oscillator producing a signal at some multiple of the harmonic being tracked, and developing for each harmonic a local reference signal that is a submultiple of the oscillator frequency by dividing down from the higher oscillator frequency signal that is synchronized by said phase-locked loop with the harmonic being tracked, and separate means responsive to the sound signal and the local reference signal thus produced for each harmonic to continually measure the power of the harmonic in said signal, and to continually generate phase data signals of the harmonic in said signal relative to said local reference signal.

22. Apparatus as defined in claim 21 including means for continually differencing power measurements made by said separate means between adjacent harmonics to obtain first differentials, and means for continually differencing between adjacent first differentials to obtain second differentials.

23. The combination defined in claim 22 wherein all of said harmonics are judiciously divided into unique groups to provide for each group a lowest common multiple of all harmonic frequencies in the group substantially lower than for all harmonics of the spectrum of interest, and wherein a separate phase-locked loop is provided for each group to track one harmonic of its group, and said higher frequency synchronized by a phase-locked loop assigned to a group is a product of the lowest common multiple of all harmonics of the group.

24. The combination defined in claim 23 wherein said higher frequency is the product of the lowest common multiple of all harmonics of the group and a factor of four, and wherein said higher frequency is divided down for each harmonic to produce a local reference signal that is four times the harmonic frequency for use in said means for power measurement, said power measuring means including means for quadrature phase detection of the component of said signal at the frequency of the harmonic the power of which is to be measured.

25. The combination defined in claim 22 wherein said means for obtaining said first differentials is comprised of means for subtracting an analog power measurement of one harmonic from another.

26. The combination defined in claim 25 wherein said means for obtaining said second differentials is comprised of means for subtracting one analog differential signal from another.

27. The combination of claim 21 wherein said separate means for continually measuring the power of the harmonic in said voiced sound signal, and for continually generating phase data signals is comprised of a quadrature power meter including means responsive to said local reference for producing sine and cosine output signals which correspond to the correlation of said voiced sound signal with sin $(2\pi ft)$ and cos $(2\pi ft)$, whereby the phase angle of said harmonic is given by the ratio of the sine to the cosine output signals, and further including means responsive to said sine and cosine signals for producing a signal proportional to the power in the said voiced sound signal at the frequency of said harmonic.

* * * * *